United States Patent [19]

Odle et al.

[11] 4,315,775

[45] Feb. 16, 1982

[54] CONTINUOUS MELTING AND REFINING OF SECONDARY AND/OR BLISTER COPPER

[75] Inventors: Robert R. Odle, Harvey, La.; Milton E. Berry; William W. Brunson; William R. Burson; Daniel B. Cofer; Roy Richards, all of Carrollton, Ga.

[73] Assignee: Southwire Company, Carrollton, Ga.

[21] Appl. No.: 98,000

[22] Filed: Nov. 28, 1979

[51] Int. Cl.[3] ..... C22B 15/14

[52] U.S. Cl. ..... 75/76; 75/24; 75/93 E; 164/473; 266/227; 266/900

[58] Field of Search ..... 75/76, 24, 93 E; 266/900, 227; 164/56

[56] References Cited

U.S. PATENT DOCUMENTS

| | | | |
|---|---|---|---|
| 3,490,897 | 1/1970 | Dore et al. | 75/76 |
| 3,715,203 | 2/1973 | De Bie | 75/76 |
| 3,947,363 | 3/1976 | Pryor et al. | 75/24 UX |
| 4,055,415 | 10/1977 | Stefan et al. | 75/76 |

*Primary Examiner*—M. J. Andrews

*Attorney, Agent, or Firm*—Herbert M. Hanegan; Frank A. Peacock; Stanley L. Tate

[57] ABSTRACT

Disclosed is an integrated system for continuously melting and refining secondary and blister copper to produce and continuously cast anode grade copper comprising: continuous melting of secondary and blister copper in an optional fuel vertical shaft furnace; continuously or semicontinuously skimming initial slag from the surface of the melted copper in a slag vessel as it drains from the shaft furnace; collecting a reservoir of molten copper in a holding furnace capable of controlling its temperature and subsequent flow; adding fluxes to the molten copper; directing the molten copper into an oxidation vessel where the molten copper and impurities are oxidized; transferring the oxidized and fluxed molten copper to a second slag vessel where slag is skimmed from its surface; flowing the oxygen rich molten copper into a reduction vessel where oxygen content is reduced; collecting a supply of refined molten copper in a final holding vessel; continuously passing the refined molten copper through a filtering ladle containing ceramic foam molten copper filters; and continuously supplying refined and filtered molten copper to a casting ladle which continuously casts the refined and filtered molten copper into anodes of suitable quality for electrorefining or into a cast product not requiring electrorefining.

22 Claims, 5 Drawing Figures

CONTINUOUS MELTING AND REFINING OF SECONDARY AND/OR BLISTER COPPER

BACKGROUND OF THE INVENTION

1. Field of the Invention

The present invention relates generally to copper refining, and specifically to a system for continuously refining secondary and blister copper to produce and continuously cast anode grade copper.

2. Description of the Prior Art

Refining impure copper to produce anode grade copper is well known in the prior art. All known prior art refining has been batch refining usually by reverberatory furnaces such as those disclosed in U.S. Pat. Nos. 2,436,124, 3,664,828 and 3,614,079. The present invention, however, is a continuous process.

The system begins with continuous melting of copper in a vertical shaft furnace so that as molten copper continuously drains from the bottom of the furnace, new copper charge is continuously or semicontinuously added to the furnace to maintain constant melting of copper. Examples of vertical shaft furnaces are disclosed in U.S. Pat. Nos. 2,283,163, 3,199,977, 3,715,203 and 3,788,623, and in U.S. Patent application Ser. No. 921,039.

The molten copper continues through various processing vessels which refine and control the flow rate of the molten copper to an intermediate ladle which contains a ceramic foam molten copper filter such as the one disclosed in U.S. Pat. No. 4,277,281. The molten copper is then continuously cast into anodes of suitable quality for electrorefining or into a cast product not requiring electrorefining.

The present invention is higher in productivity, consumes less energy and causes less idle and downtime than conventional batch-type systems.

SUMMARY OF THE INVENTION

This invention solves the problems in the prior art of wasted time, labor and energy. The present invention is an integrated system for continuously refining secondary and/or blister copper to produce and continuously cast anode grade copper. Secondary copper includes No. 2 grade copper, defined by NARI Circular NF 77 Standard Classification of Nonferrous Scrap Metals as 96% minimum average copper with no single impurity over 1% and normal significant impurities being Pb, Sn, Fe, Ni and Sb. Blister copper elements vary widely but typical impurity concentrations are:

Pb: 10 to 1,000 PPM
Sn: 10 to 1,000 PPM
Fe: 100 to 1,000 PPM
Ca: 100 to 1,000 PPM
S: 100 to 500 PPM
Zn: 200 PPM

This system continuously melts secondary and blister copper in an optional fuel vertical shaft furnace. Gas or liquid fuel is used to fire the furnace depending on economics and logistics. As the copper melts and flows down the shaft furnace, it drains out of the furnace into a first slag vessel where initial slag is skimmed from its surface. The molten copper is then collected in a high capacity holding furnace capable of controlling its temperature and subsequent flow. As fluxes such as silica, lime and the like are added, the molten copper is directed in a controlled manner into an oxidation vessel where the molten copper is oxidized by air, oxygen or like oxidization agent. From the oxidation vessel, the oxidized and fluxed molten copper enters a second slag vessel where slag reacting from processing in the oxidation vessel is skimmed from its surface. The oxygen-rich molten copper then flows into a reduction vessel where its oxygen content is reduced by ammonia or like suitable reducing agent to complete what is often called fire refining. A final holding vessel collects the refined molten copper and continuously passes it through a filtering ladle containing ceramic foam molten copper filters to a casting ladle for subsequent continuous casting of the refined and filtered molten copper into anodes of suitable quality for electrorefining or into a cast product not requiring electrorefining.

Thus an important object of the present invention is to provide a system for continuously refining secondary and blister copper to produce and continuously cast anode grade copper.

Another object of the present invention is to provide a system for continuously melting secondary and blister copper in an optional liquid or gas fueled vertical shaft furnace to continuously fire-refine copper.

Still another object of this invention is to provide a system for reducing the time required for fire refining anode grade copper.

Yet another object of the present invention is to provide a system for reducing the labor required for fire refining anode grade copper.

Another object of this invention is to provide a system for reducing the energy required for fire-refining anode grade copper.

Still another object of the present invention is to provide a system for producing refined copper intermediate and finished products with substantially less impurities than traditional fire-refined copper by continuously melting, fire refining and filtering secondary and blister copper in one integrated process.

BRIEF DESCRIPTION OF THE DRAWINGS

While the specification concludes with claims particularly pointing out and distinctly claiming the subject matter which is regarded as the invention, it is believed that the invention, objects, features and advantages thereof will be better understood from the following description taken in connection with the accompanied drawings in which like parts are given like identification numerals and wherein:

DESCRIPTION OF THE PREFERRED EMBODIMENT

Figure 1:
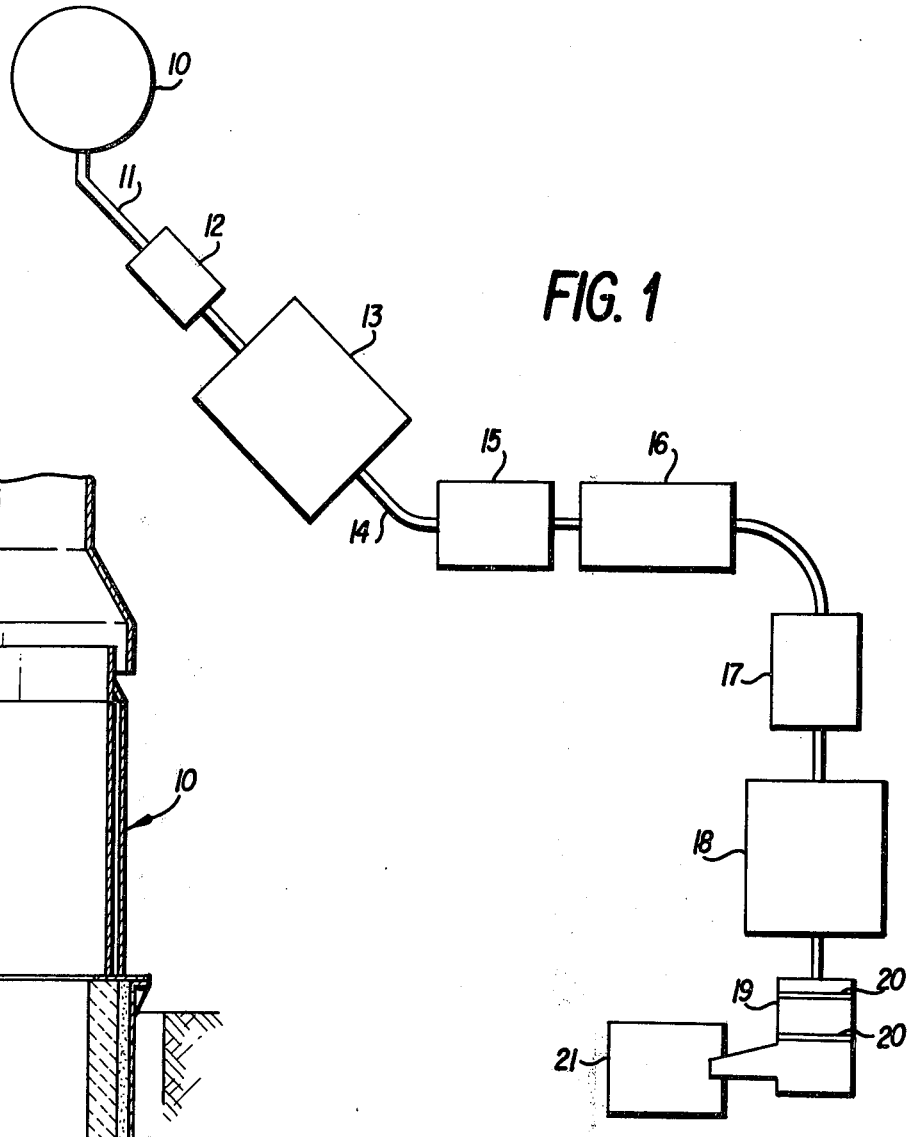
FIG. 1 is an overhead view of the present invention.

FIG. 1 illustrates all of the major components of the present invention. Its overhead perspective provides a flow chart to visualize the processing of copper by the present invention.

Secondary and blister copper are charged into an optional fuel vertical shaft furnace 10 where it is melted. As the copper melts, it continuously flows down the vertical shaft furnace 10 and out the bottom, through a launder 11 to an initial slag vessel 12 where initial slag is skimmed off. A reservoir of molten copper collects in a high capacity primary holding furnace 13 which is capable of controlling the temperature and subsequent flow of molten copper. As fluxes are added as necessary to launder 14, the molten copper is supplied in a controlled manner to an oxidation vessel 15 where oxygen is added. The oxidized and fluxed molten copper is then transferred to a major slag vessel 16 where slag resulting from processing in the oxidation vessel 15 is skimmed from its surface. The oxygen-rich molten copper then flows into a reduction vessel 17 where its oxygen content is reduced to complete the fire refining portion of the process. A final holding furnace 18 collects refined molten copper and continuously passes it at a controlled rate through a filtering ladle 19 containing ceramic foam molten copper filters 20 to a casting ladle 21 for continuous casting of the refined and filtered anode grade molten copper into final products or anodes suitable for subsequent electrorefining.

Reference to the remaining figures further defines specific portions of this integrated process.

Figure 2:
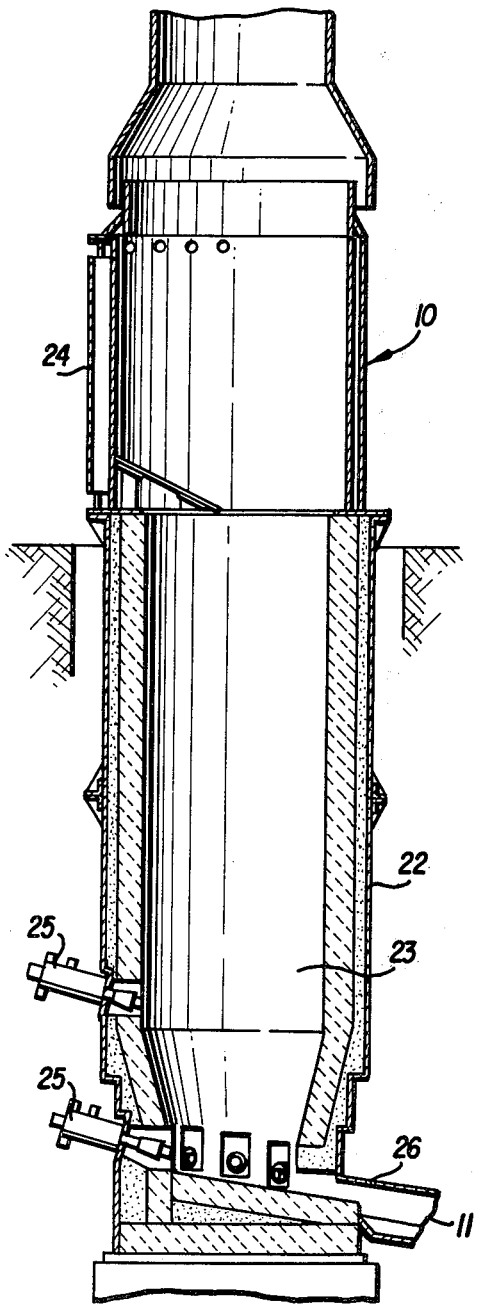
FIG. 2 is a partial elevation of the vertical shaft furnace component of the present invention.

FIG. 2 shows the vertical shaft furnace 10 of the present invention in greater detail. This furnace 10 is the type having a refractory lined wall 22 enclosing a melting chamber 23, a charge entrance 24 near the top of the melting chamber, a plurality of optional fuel fired burners 25 affixed to the lower portion of the wall 22 for injecting heat into the melting chamber 23, and an outlet 26 in the bottom of the melting chamber 23 for continuously discharging molten copper.

Figure 3:
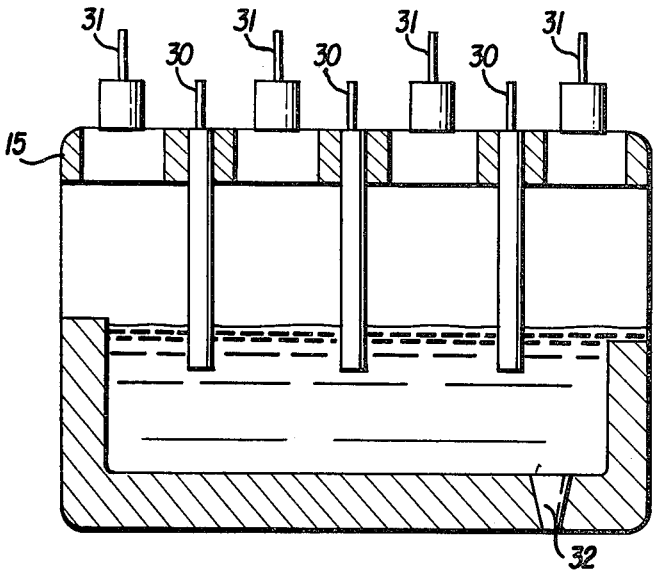
FIG. 3 is a cross-sectional view of the oxidation vessel component of the present invention.
Figure 4:
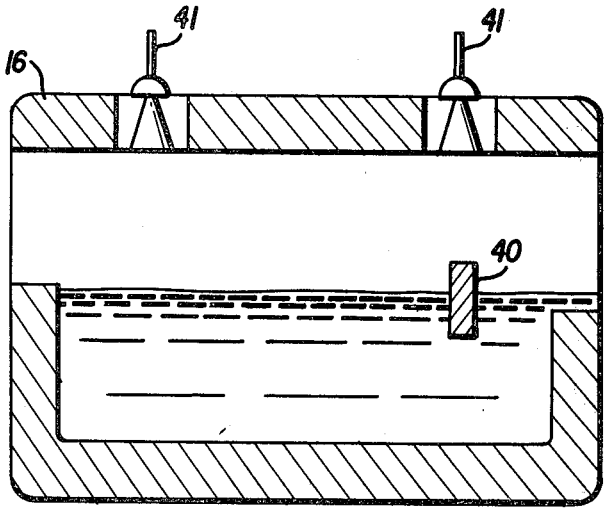
FIG. 4 is a cross-sectional view of the major slag vessel component of the present invention.

FIG. 3 illustrates the oxidation vessel 15 of the present invention. Molten copper is received in a controlled manner by the oxidation vessel 15 where air, oxygen-enriched air, or other oxidizers are injected into the melt through blow pipes 30 to raise oxygen content of the copper from 0.1% to about 0.7%. Open burners 31 are located between the blow pipes 30 to maintain the melt with minimum splashing, and an emergency knockout drain plug 32 is located at the bottom. As silica and lime-type fluxes, which were added to the melt immediately upstream of the oxidation vessel 15, begin to react with the impurities in the copper and the oxygen, the melt moves downstream to the major slag vessel 16 shown in FIG. 4.

In the major slag vessel 16, the resulting slag is continuously skimmed from the surface of the melt by the combined efforts of a skim brick 40 and a plurality of impinging burners 41, and continuously overflows into a slag pot (not shown).

Figure 5:
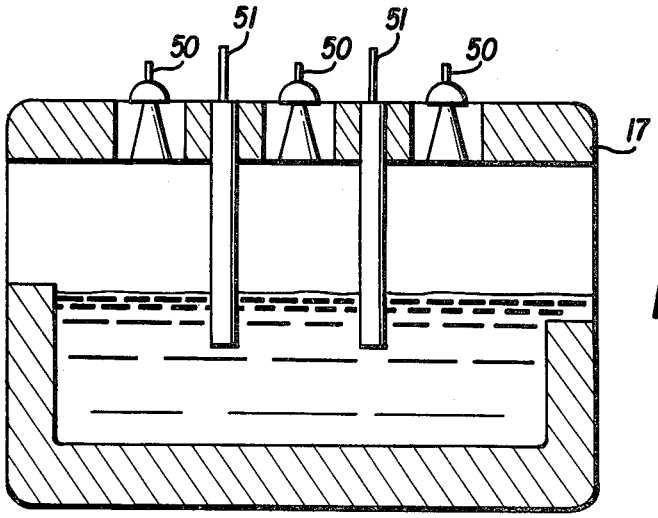
FIG. 5 is a cross-sectional view of the reduction vessel component of the present invention.

The skimmed molten copper continues into the reduction vessel 17 shown in detail at FIG. 5. A plurality of burners 50 temperature, while ammonia or like reducing agent is injected into the melt through a plurality of lances 51 which are sized to closely control bubble size for creating small bubbles to effeciently deoxidize the melt.

This embodiment is, of course, merely exemplary of the possible changes or variations. Because many varying and different embodiments may be made within the scope of the inventive concept disclosed herein and because many modifications may be made in the embodiment herein detailed in accordance with the descriptive requirements of the law, it should be generally understood that the details herein are to be interpreted as illustrative and not in a limiting sense.

What is claimed is:

1. An improved process for continuously refining secondary and blister copper to produce and continuously cast anode grade copper of the type including the successive steps of melting, oxidizing, slagging, then reducing the copper, thereby removing impurities therefrom;

wherein the improvement comprises the separate steps of:

(a) continuously melting copper containing impurities in a vertical shaft furnace, converting some of the impurities to initial slags and adjusting the oxygen content of the molten copper to about 0.1% therein, to produce a substantially continuous stream of molten copper containing impurities and slags;

(b) flowing said stream into a first slag vessel, located between said shaft furnace and a subsequent holding furnace skimming initial slag from the surface of the molten copper stream while in said slag vessel as said stream drains from the shaft furnace towards a holding furnace;

(c) flowing said stream into a first holding furnace and controlling the temperature and flow of molten copper while in the holding furnace;

(d) directing the molten copper stream from the holding furnace into an oxidation vessel;

(e) continuously oxidizing the molten copper and the impurities forming slag suspended in the flowing stream of oxidized copper;

(f) continuously transferring the stream of oxidized molten copper and the slag having the impurities from the oxidation vessel to a second slag vessel;

(g) reducing the flow rate of said stream in said second slag vessel so that suspended slag particles float towards the surface of the molten copper stream, separating said stream into an upper layer containing mostly molten slag and a lower layer containing mostly molten copper, then skimming said upper layer of slag from the copper surface thereby removing most impurities from the flowing stream of oxidized copper;

(h) flowing the oxygen rich molten copper stream into a reduction vessel;

(i) continuously injecting small bubbles of ammonia into the bottom of said reduction vessel, and allowing said ammonia to react with oxygen rich molten copper stream, thereby reducing the oxygen content of the copper;

(j) collecting a supply of refined molten copper in a second holding vessel while regulating the temperature and flow rate of molten copper from said vessel;

(k) supplying the refined molten copper to a casting ladle; and (l) casting the refined molten copper into molds to form solid products.

2. The process of claim 1 where in step (a) the furnace is fired with a gaseous fuel.

3. The process of claim 1 where in step (a) the furnace is fired with a liquid fuel.

4. The process of claim 1 where in step (b) the slag is skimmed continuously from the stream of molten copper.

5. The process of claim 1 including adding fluxes to the stream of molten copper containing impurities after said stream exits the holding furnace.

6. The process of claim 1 including passing the refined molten copper through a filtering ladle having ceramic filter elements prior to casting said copper.

7. The process of claim 6 wherein said filtering ladle contains a rigid ceramic foam filter element.

8. The process of claim 7 wherein said ceramic foam filter is an open pore filter having volume fraction voids of from 75% to 95%.

9. The process of claim 7 wherein the refined and filtered molten copper is continuously cast into anode.

10. An improved process for producing anode grade copper of the type including the successive steps of charging secondary or blister copper into a first furnace, melting the copper in the first furnace, and then refining the molten copper in subsequent furnaces to remove impurities therefrom by oxidizing, slagging, then reducing the molten metal;

wherein the improvement is characterized in that the process is a continuous process and includes the steps of:

(a) continuously charging the secondary or blister copper containing impurities into the top of a vertical shaft furnace, (b) continuously melting the copper charge in the vertical shaft furnace under slightly oxidizing conditions, converting some of the impurities to slags and to raise the oxygen content of the molten copper to about 0.1%

(c) continuously flowing molten copper out of the bottom of the vertical shaft furnace to and through a first slag vessel, located adjacent said furnace; separating the slags from the stream of molten copper, flowing the copper stream into a second furnace, adjusting the temperature and flow of the molten copper therein; and (d) continuously refining the molten copper to produce anode grade copper by flowing the molten copper into a third, oxidization, furnace.

11. A process according to claim 10, further characterized in that the refining step includes the steps of:

(e) continuously oxidizing the molten copper sufficiently to raise its oxygen content from about 0.1% to about 0.7% in order to cause impurities to form slag and flow to the surface thereof, and (f) continuously flowing the oxidized molten copper and slag out of said oxidizing furnace into a second slag vessel, reducing the flow rate of the copper in said second slag vessel so that the slag floats towards the surface of the copper, then skimming the slag containing impurities from the surface of the molten copper.

12. A process according to claim 10 or 11, characterized in that the refining step further includes the step of:

(g) flowing the oxidized molten copper into a fourth, reduction, furnace and injecting small bubbles of ammonia through the melt.

13. A process according to claim 11, further characterized by adding fluxes to the molten copper prior to oxidation thereof.

14. A process according to claim 10, characterized in that the furnace is fired by a gaseous fuel or a liquid fuel.

15. A process according to claims 10, 11, 13, or 14, further characterized by the step of continuously casting the copper into anode form.

16. A process according to claim 15, further characterized by passing the refined molten copper through a filtering ladle having ceramic filter elements prior to continuously casting said copper.

17. A process according to claim 16, characterized in that said filtering ladle contains a rigid ceramic foam filter element.

18. A process according to claim 17, characterized in that said ceramic foam filter is an open pore filter having volume fraction voids of from 75% to 95%.

19. A process according to claim 17, characterized in that said ceramic foam is selected from the group consisting of metallic oxides and metallic phosphates.

20. A process according to claim 19, characterized in that the predominate metallic oxide is aluminum oxide.

21. A process according to claim 19, characterized in that the predominate metallic oxides are aluminum and chromic oxides.

22. A process according to claim 19, characterized in that the ceramic form is predominately aluminum oxide and aluminum phosphate.

* * * * *